United States Patent [19]

Jepson et al.

[11] 3,937,474

[45] Feb. 10, 1976

[54] GOLF CLUB WITH POLYURETHANE INSERT

[75] Inventors: John W. Jepson, Marion; Earle F. Allen, Jr., Dartmouth, both of Mass.

[73] Assignee: Acushnet Company, New Bedford, Mass.

[22] Filed: Feb. 25, 1974

[21] Appl. No.: 445,462

Related U.S. Application Data

[63] Continuation of Ser. No. 122,753, March 10, 1971, abandoned.

[52] U.S. Cl. ..... 273/173; 273/DIG. 8; 273/78; 260/77.5 AP

[51] Int. Cl.[2] ..... A63B 53/04

[58] Field of Search ..... 273/78, 167–175, 273/218, 235, DIG. 8; 260/22, 75, 77.5

[56] References Cited

UNITED STATES PATENTS

| | | | |
|---|---|---|---|
| 2,968,575 | 1/1961 | Mallonee | 273/DIG. 8 |
| 3,172,667 | 3/1965 | Baker et al. | 273/173 |
| 3,188,302 | 6/1965 | Lorenz | 260/77.5 |
| 3,224,781 | 12/1965 | Hutchison | 273/173 X |
| 3,233,905 | 2/1966 | Flom | 273/173 |
| 3,390,881 | 7/1968 | Senne | 273/173 |
| 3,482,386 | 12/1969 | Smith | 273/DIG. 8 |
| 3,507,495 | 4/1970 | Tucker et al. | 273/DIG. 8 |
| 3,520,969 | 7/1970 | Smith | 273/DIG. 8 |
| 3,571,900 | 3/1971 | Hardesty | 273/173 X |
| 3,717,344 | 2/1973 | Infantino | 273/DIG. 8 |

*Primary Examiner*—Richard J. Apley
*Attorney, Agent, or Firm*—Eyre, Mann & Lucas

[57] ABSTRACT

Golf clubs are provided with polyurethane inserts on the striking face. These golf clubs have been found to have advantage over standard golf clubs in that a golf ball hit with these clubs travels a greater distance, all other conditions being equal.

1 Claim, 1 Drawing Figure

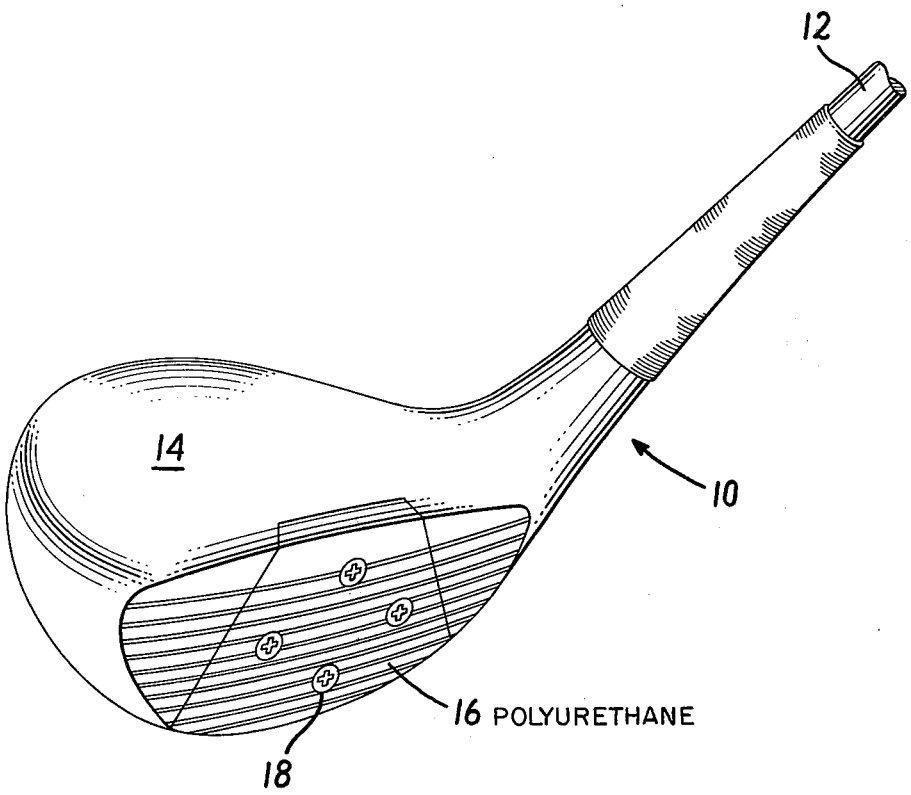
INVENTOR.
BY

GOLF CLUB WITH POLYURETHANE INSERT

This is a continuation of application Ser. No. 122,753, filed Mar. 10, 1971 and now abandoned.

The present invention relates to an improvement in golf clubs known as "woods." "Woods" comprise a shaft, a club head block and usually an insert on the striking face of the club head block. The improvement of the present invention comprises a polyurethane insert on the striking face of the golf club. When all other conditions remain the same the golf club with the polyurethane insert will drive a golf ball further than a standard golf club.

In the game of golf it is usually desired to get the greatest possible distance with the golf clubs known as "woods." While many changes have been made in golf balls in order to increase the distance they will travel, the applicants have discovered a change which can be made in the golf club in order to increase the distance which the golf ball will travel. Heretofore, many different materials have been tried for insert in golf club heads, including ivory, steel, aluminum and many different plastic compositions. In choosing the insert, current thinking is that it should be as hard as possible so that no dynamic losses of energy take place when the insert impacts the ball. Commonly used materials today for the insert are laminated phenolics which are quite hard materials as is exemplified by the fact that they usually have a Rockwell hardness from about M90–120 for typical golf club inserts.

The applicants have now discovered that it is not always necessary to use a hard material for the insert and that, in fact, there is advantage in using polyurethane which is a relatively soft material with a Shore D hardness up to about 80. Quite surprisingly, the resilience of the polyurethane seems to impart additional energy to the golf ball rather than causing losses of energy as was previously thought to be true of relatively soft materials.

The polyurethanes which were useful in the practice of the present invention are the urethane pre-polymers made from polyesters or polyethers with diisocyanates. Although any diisocyanate may be employed, the preferred diisocyanates are 2,4 tolylene diisocyanate (TDI), 4,4′ diphenylmethane diisocyanate (MDI), and 3,3′ dimethyl 4,4′ biphenylene diisocyanate (also known as 3,3′ dimethyl 4,4′ biphenyl diisocyanate) (TODI). The polyether part of the pre-polymer is preferably a polyalkylene ether glycol having an average molecular weight of less than 1,000 and having from about four to about eight carbon atoms in the alkylene group. Best results have been obtained with polytetramethylene ether glycol. The preferred polyesters in the pre-polymer are polycondensation products of linear dicarboxylic acids and dihydric alcohols which yield a polyester with alcoholic hydroxy terminal groups. Best results have been obtained with the polycondensation product of diethylene glycol and adipic acid.

The pre-polymer is cured with either a polyol or an amine-type curing agent. The polyol curing agents may be either di-functional, tri-functional or tetra-functional but best results have been achieved with the tri-functional and tetra-functional polyol curing agents. Examples of polyol type curing agents useful in the practice of the present invention are triisopropanol amine (TIPA) and trimethylol propane (TMP). Best results have been obtained with the TMP. As to the amine-type curing agents, there must be at least two amine groups present and best results have been obtained with aromatic diamines. Typical amine-type curing agents which are useful in the practice of the present invention are: 3,3′ dichlorobenzidene; 3,3′ dichloro, 4,4′ diamino diphenyl methane (MOCA); N,N,N′,N′ tetrakis (2-hydroxy propyl) ethylene diamine (sold by Wyandotte under the trade name Quadrol); and Curalon L which is Uniroyal Inc.'s brand name for a mixture of aromatic diamines.

In forming the insert of the present invention the pre-polymer and the curing agent are mixed in an equivalent weight ratio of 1:1 ± 20% and best results have been obtained with an equivalent weight ratio of 1:1 ± 10%. The amount of curing agent to be added is computed in the following formula:

$$C = \frac{(E_C)(\%I)}{(E_I)}$$

wherein:

$C$ = the parts of curing agent to be employed per 100 parts of prepolymer;

$E_I$ = the equivalent weight of the isocyanate linkage in the prepolymer (which will be 42.0);

$\%I$ = the percentage by weight of available isocyanate in the prepolymer; and $E_C$ = the equivalent weight of the curing agent (determined by dividing the molecular weight of the curing agent by the number of sites available for curing).

The above formula will result in an equivalent weight ratio of 1:1 for curing agent to prepolymer. The amount of curing agent may then be varied up to 20 percent in either direction. A computation according to the above formula is given in Example 1.

As a general rule the pre-polymer and the curing agent are thoroughly mixed at a temperature ranging from ambient to 250°F. and then are formed into the shape of an insert as by open casting, compression molding, transfer molding or other known techniques. The insert is then cured and this is typically at from about 200°F. to about 300°F. for about 1 to about 24 hours. The curing time can be decreased in known manner by using catalysts (e.g., stannous octoate where the polyol-type curing agent is used).

While the polyurethane insert has been described with respect to particular pre-polymers and curing agents, it has been found that a polyurethane insert having the advantages of the present invention will always be obtained if the pre-polymer and curing agent are selected to yield a compound with the following physical properties: tensile strength from about 1,500 to about 8,000 psi as measured by ASTM Standard D 412, hardness from about 40 to about 75 on the Shore durometer D scale according to ASTM Standard D 2240, elongation from about 50% to about 300% as measured by ASTM Standard D 412, rebound value on a Bashore Resiliometer as measured by ASTM Standard D 2632–67, above about 17 and preferably from about 33 to about 48.

These and other aspects of the present invention may be more fully understood with reference to the drawing and illustrative examples as set out hereinbelow.

In the drawing is shown a standard golf club 10 with shaft 12 (not completely shown), club head block 14, insert 16 and screw attachment means 18. The club head shaft 12 may be made of any standard material such as steel, aluminum, fiberglass or the new lightweight alloys. The club head block 14 may likewise be made of any standard material such as aluminum or wood, and the preferred club head block is made of persimmon wood. The plastic insert 16 according to the present invention is made of polyurethane as described in the specification. The insert in the preferred embodiment is a truncated triangle about ¼ inch thick but the insert may be in any shape desired, and may cover the entire face of the club head if desired. Excellent results are obtained when the insert is from about three-sixteenth inch to about seven-sixteenth inch thick. The insert 16 is firmly secured to the club head block 14 by any means although the preferred means comprises an adhesive between the club head block and the insert and also screw attachment means 18 as shown in the drawing. While the club head face is shown with grooves therein, these grooves are not essential to obtain the improved distance imparted by the polyurethane inserts of the present invention. The completed club head may be coated with a finish in conventional manner.

The following are representative examples of polyurethane inserts made in accordance with the present invention:

EXAMPLE 1

100 parts of Adiprene 315 pre-polymer was admixed with 14 parts of triisopropanol amine, which was the curing agent. Adiprene 315 is Dupont's trademark for a urethane pre-polymer which is a product of a polytetramethylene ether glycol and tolylene diisocyanate. The amount of curing agent to be added was computed from the formula:

$$C = \frac{(E_C)\,(\%I)}{(E_I)}$$

wherein:

$C$ = the parts of curing agents to be employed per 100 parts of pre-polymer;

$E_I$ = the equivalent weight of the isocyanate linkage in the pre-polymer and is 42.0;

$\%I$ = the percentage by weight of available isocyanate in the pre-polymer and is 9.25 %; and $E_C$ = the equivalent weight of the curing agent. The molecular weight of triisopropanol amine is 191.27. Since there are three sites available for curing, the equivalent weight of the curing agent is 63.76.

Substituting these values in the formula, $$C = \frac{(63.76)\,(9.25)}{42} = 14 \text{ parts}$$

As stated hereinbefore, the mole ratio of the pre-polymer to the curing agent is 1:1 ± 20%. Therefore, the parts of triisopropanol amine which can be added per 100 parts of Adiprene 315 is about 11.2 parts to about 16.8 parts. In the present example, 14 parts of the curing agent were employed.

After the pre-polymer and the curing agent were thoroughly admixed at 250°F., the product was cast to a thickness of about one-quarter inch. The cast product was then press cured for 15 minutes at 230°F. removed from the mold and oven cured for 3 hours at 230°F. The cast products was then cut into the shape of an insert for a wooden type golf club, and the insert was shaped essentially as shown in the FIGURE The golf club with the polyurethane insert was then compared to a golf club with the polyurethane insert except for the inserts themselves. In a number of tests on a golf ball driving machine, golf balls hit with the club having the polyurethane insert traveled further than golf balls hit with the same golf club having a phenolic insert. This increased distance was from 1–5 yards on a 250 yard drive.

EXAMPLE 2

A polyurethane insert was made in accordance with Example 1 except that 11.2 parts of triisopropanol amine were used per 100 parts of Adiprene 315. Comparable results were obtained.

EXAMPLE 3

A polyurethane insert was made in accordance with Example 1 except that 16.8 parts of triisopropanol amine were used per 100 parts of Adiprene 315. Comparable results were obtained.

EXAMPLE 4

A polyurethane insert was made in accordance with Example 1 from 100 parts of Adiprene 315 and 29.4 parts of 3,3′ dichloro 4,4′ diamino diphenyl methane. When the polyurethane insert was tested in a golf club, there was significant improvement in yardage as compared to a comparable club having a phenolic insert.

EXAMPLE 5

In this case 100 parts of Adiprene 315 were cured with 9.85 parts of trimethylol propane according to the method taught in Example 1. Comparable results to those given in Example 1 were obtained.

Example 6

A polyurethane insert was formed from 100 parts of Adiprene LD 955 and was cured with 16.1 parts of N,N,N′,N′ tetrakis (2-hydroxypropyl) ethylene diamine according to the procedure of Example 1. Comparable results to those given in Example 1 were obtained.

EXAMPLE 7

In this example a pre-polymer which is a product of a glycol adipic acid ester and tolylene diisocyanate was used. 100 parts of the pre-polymer was cured with 29.6 parts of 3,3′ dichloro 4,4′ diamino diphenyl methane according to the method of Example 1. When the polyurethane insert was tested in a golf club, comparable results to those of Example 1 were obtained.

EXAMPLE 8

A polyurethane insert was formed from 100 parts of the pre-polymer of Example 7 cured with 33.1 parts of Curalon L (Uniroyal Inc.'s brand name for a mixture of aromatic diamines) according to the method of Example 1. When the polyurethane insert was compared to a phenolic insert as in Example 1, a significant increase in yardage was obtained.

EXAMPLE 9

A polyurethane insert was made with 100 parts Adiprene 315 and 33 parts of Curalon L according to the method of Example 1. Comparable results to those of Example 1 were obtained.

EXAMPLE 10

A polyurethane insert was formed from 100 parts of Adiprene 315 cured with 27.8 parts of dichlorobenzidene according to the method of Example 1. When the polyurethane insert was compared to a phenolic insert, a significant improvement in distance was obtained.

EXAMPLE 11

A polyurethane insert was made in accordance with Example 1 from 100 parts of Adiprene L-315 and 16.45 parts of N,N,N′,N′-tetrakis(2-hydroxypropyl) ethylene diamine (a tetrafunctional polyol). This insert had a hardness value on the Shore D scale of 50. When this polyurethane insert at a thickness of one-quarter inch was used in a golf club, the same as the golf club with the phenolic insert of Example 1, it was found that the insert of the present invention gave an average improvement of 9.46 yards in a statistically significant number of tests.

EXAMPLE 12

A polyurethane insert was made in accordance with Example 1 from 100 parts of Adiprene L-315 and 24.5 parts of 4,4′-methylene-bis-2-chloroaniline. This insert had a hardness value on the Shore D scale of 70. When this polyurethane insert at a thickness of one-quarter inch was used in a golf club, the same as the golf club with the phenolic insert of Example 1, it was found that the insert of the present invention gave an average improvement of 11.64 yards in a statistically significant number of tests.

PHYSICAL PROPERTIES

All of the polyurethane inserts of Examples 1–10 had physical properties within the following limitations:

- Tensile strength from about 1,500 to about 8,000 p.s.i. as measured by ASTM Standard D 412;
- Hardness from about 40 to about 75 on the Shore Durometer D Scale according to ASTM Standard D 2240;
- Elongation from about 50% to about 300% as measured by ASTM Standard D 412;
- Rebound value on a Bashore Resiliometer as measured by ASTM Standard D 2632-67, above about 17.

It will be understood that it is intended to cover all changes and modifications of the preferred embodiments of the invention, herein chosen for the purpose of illustration, which do not constitute departures from the spirit and scope of the invention.

What is claimed is:

1. In a golf club comprising a shaft and a club head, the improvement which comprises a polyurethane striking plate of about ¼ inch thickness and a hardness of from about 40 to about 75 on the Shore Durometer D Scale according to ASTM Standard D 2240 affixed to the striking face of the club head, said polyurethane being a cured reaction product of components consisting essentially of a prepolymer consisting essentially of a polytetramethylene ether glycol combined with toluene diisocyanate and having about 9.5% free isocyanate, and a curing agent for the prepolymer selected from the group consisting of tetrafunctional polyols and 4,4′-methylene-bis-2-chloroaniline, and wherein the prepolymer and the curing agent are in an equivalent weight ratio of about 1:1 for the tetrafunctional polyols and about 1.2:1 for the 4,4′-methylene-bis-2-chloroaniline.

* * * * *

UNITED STATES PATENT OFFICE

CERTIFICATE OF CORRECTION

PATENT NO. : 3,937,474

DATED : February 10, 1976

INVENTOR(S) : John W. Jepson and Earle F. Allen

It is certified that error appears in the above-identified patent and that said Letters Patent are hereby corrected as shown below:

Col. 3, Line 45: "90I" should read --%I--

Col. 3, Last Line: "products" should read --product--

Col. 4, Lines 2 - 5: "The golf.....inserts themselves."

should read --The golf club with the polyurethane insert was then compared to a golf club having a standard phenolic insert. The golf club with the phenolic insert was the same in all respects to the golf club with the polyurethane insert except for the inserts themselves.--

References Cited: "3,482,386" should read --3,482,836--

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*